United States Patent [19]

Eberhardt

[11] 4,311,440

[45] Jan. 19, 1982

[54] PUMP

[75] Inventor: H. Alfred Eberhardt, Paoli, Pa.

[73] Assignee: Hale Fire Pump Company, Conshohocken, Pa.

[21] Appl. No.: 757,049

[22] Filed: Jan. 5, 1977

[51] Int. Cl.[3] ..... F04B 39/14

[52] U.S. Cl. ..... 417/360; 418/104

[58] Field of Search ..... 417/410, 206, 360, 423 R; 418/182, 104, 140

[56] References Cited

U.S. PATENT DOCUMENTS

| | | | |
|---|---|---|---|
| 2,112,890 | 4/1938 | Gunn | 417/423 R |
| 2,192,588 | 3/1940 | Heckert | 418/182 |
| 2,545,604 | 3/1951 | Byram | 418/182 |
| 3,303,791 | 2/1967 | Doble | 418/154 |
| 3,433,166 | 3/1969 | Birkemeier | 418/182 |
| 3,526,469 | 9/1970 | Lipe et al. | 417/360 |
| 3,982,856 | 9/1976 | Hehl | 417/360 |

FOREIGN PATENT DOCUMENTS

| | | | |
|---|---|---|---|
| 466726 | 7/1950 | Canada | 417/410 |
| 1451727 | 8/1969 | Fed. Rep. of Germany | 418/104 |
| 2259438 | 6/1974 | Fed. Rep. of Germany | 417/410 |
| 1229123 | 9/1960 | France | 417/423 |
| 741767 | 12/1955 | United Kingdom | 417/410 |
| 848761 | 9/1960 | United Kingdom | 418/104 |

OTHER PUBLICATIONS

"Hale Type Priming Pump", Hale Fire Pump Co., Brochure Plate No. 492A, 12/74.

*Primary Examiner*—Richard E. Gluck
*Attorney, Agent, or Firm*—Harding, Earley & Follmer

[57] ABSTRACT

A vacuum pump adapted to be used as a priming pump comprising a pump assembly and a motor assembly both of which are secured to a mounting head located therebetween. The motor assembly includes a housing and a motor shaft extending a substantial extent from the housing. The mounting head has a bore aligned with the central bore of the rotor of the pump assembly. The motor assembly is secured to the mounting head with the motor shaft extending through the bore in the mounting head into the central bore of the rotor for driving the same.

3 Claims, 6 Drawing Figures

PUMP

BACKGROUND OF THE INVENTION

This invention relates generally to vacuum pumps and more particularly to vacuum pumps adapted to be used as priming pumps.

Pumps of the indicated type have in the past comprised a pump assembly, a motor assembly, a mounting assembly, and a drive coupling. The pump assembly includes a rotor and a rotor drive shaft which projects out through a mounting head for connection to one side of the drive coupling. The pump assembly is provided with suitable bearings for the rotor drive shaft. The motor assembly is provided with an end plate and a shaft projecting therefrom for connection to the other side of the drive coupling.

While the above-described prior art pumps are satisfactory, they do involve a substantial number of parts which adds to the cost of manufacture.

SUMMARY OF THE INVENTION

It is the general object of this invention to provide a priming pump of the indicated type which is compact, has a minimum number of parts, and is inexpensive to manufacture.

To this end, the priming pump in accordance with the invention is provided with a pump assembly which includes a pump housing having a suction and discharge opening and a rotor rotatably mounted within the housing for pumping fluid between the suction and discharge openings, the rotor having a central bore for receiving a drive shaft. The pump also includes a motor assembly which comprises a motor housing and a motor shaft which extends from the housing a substantial extent. The pump is provided with a mounting head enclosing one end of the pump assembly and having a shaft bore, the pump assembly being secured to one side of the mounting head. Means are provided for securing the motor assembly to the other side of the mounting head with the motor shaft extending through the shaft bore of the mounting head and into the rotor central bore for driving the same.

By reason of the above-described construction, it is possible to improve alignment between the pump and driving motor and to eliminate many of the parts of the prior priming pumps. Thus, the entire drive coupling which includes a plurality of parts is eliminated, and the pump assembly does not have to be provided with bearings for a rotor drive shaft. Also, only a single piece mounting head is necessary and this mounting head serves to support both the motor assembly and the pump assembly. Further, the mounting head is adapted to serve a plurality of functions, namely, to align the pump and motor assemblies with the drive shaft extending from the motor assembly into the bore of the rotor, to support both the pump assembly and the motor assembly, to serve as a common end cover for the motor assembly and the pump assembly, to provide a drain passage for liquid which may seep out of the pump housing, and to provide a housing for the seals for the motor shaft as it extends into the rotor bore.

Accordingly, the pump construction in accordance with the invention requires a minimum number of parts, is inexpensive to manufacture and is a very compact construction.

In accordance with another feature of the invention, the end clearance of the rotor is maintained within the critical tolerances necessary to achieve the maximum vacuum obtainable with the pump.

DETAILED DESCRIPTION OF THE PREFERRED EMBODIMENT

Figure 2:
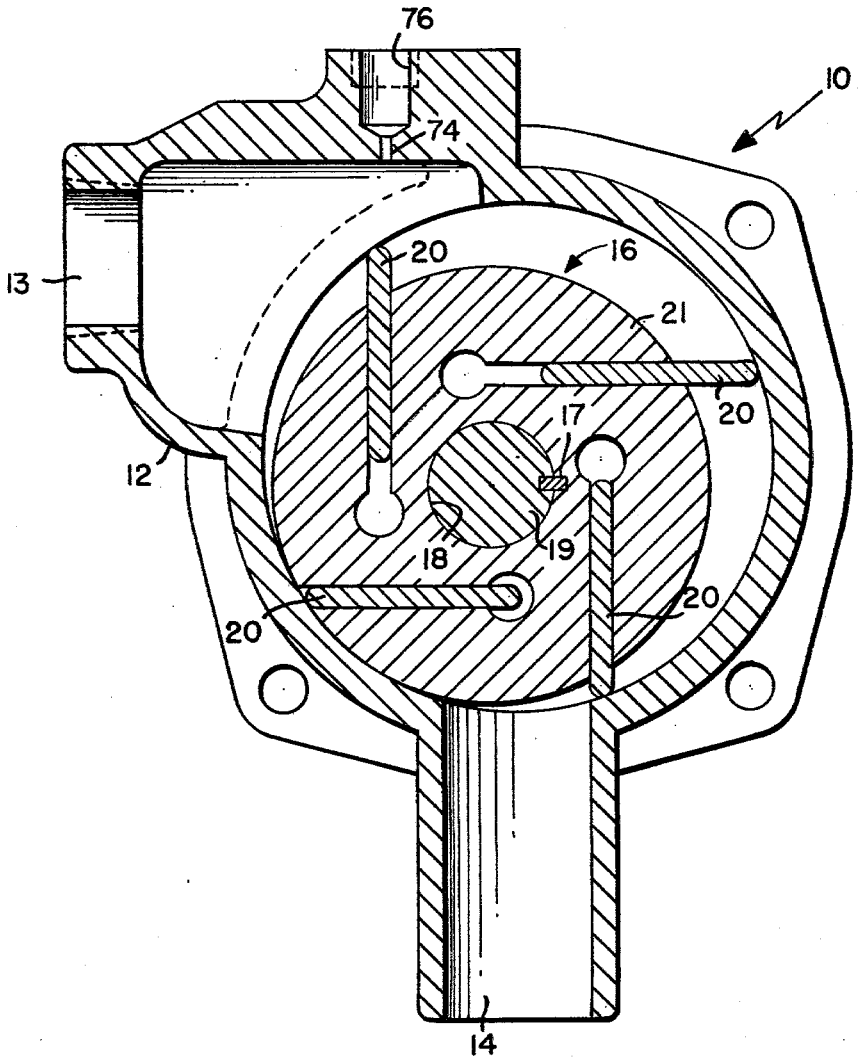
FIG. 2 is a section taken generally on line 2—2 of FIG. 1.
Figure 3:
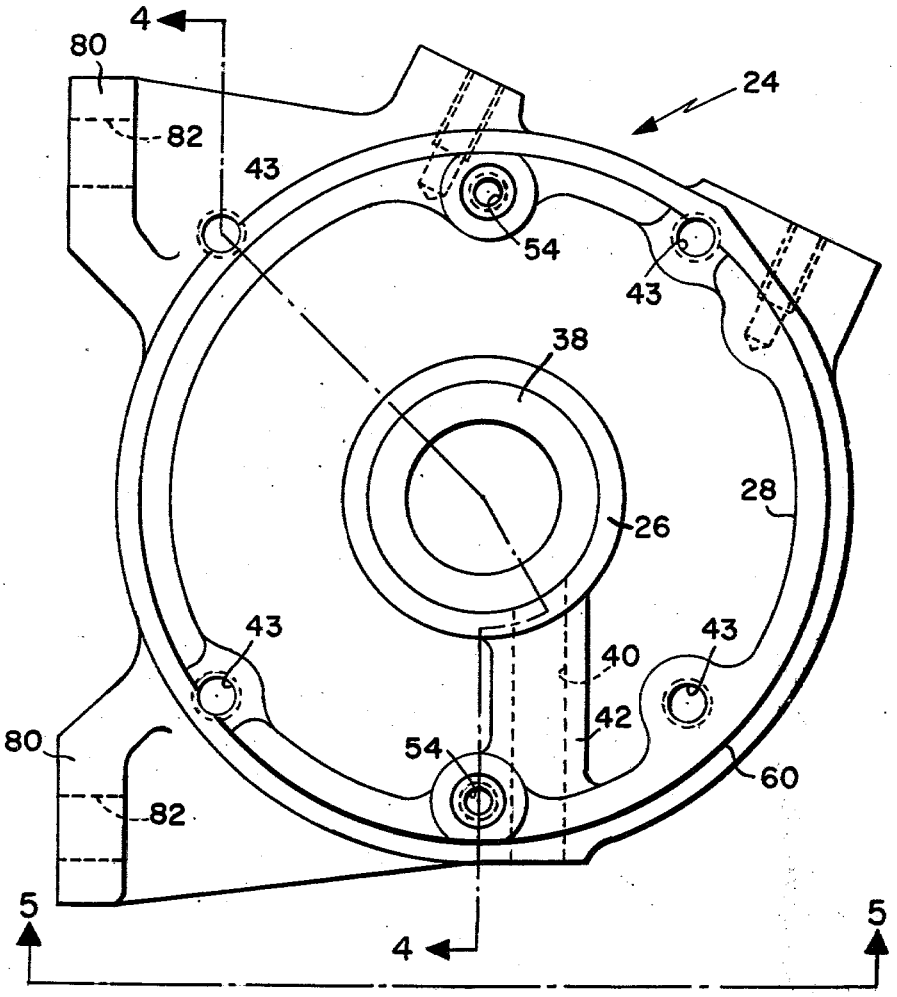
FIG. 3 is a view of one side of the mounting head used in the pump shown in FIG. 1.
Figure 5:
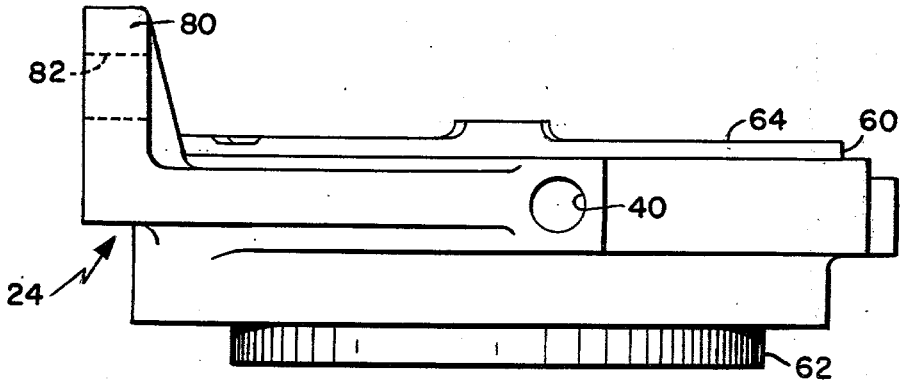
FIG. 5 is an end view taken on line 5—5 of FIG. 3.

The pump in accordance with the invention comprises a pump assembly 10 which comprises a positive displacement vane type vacuum pump which includes a pump housing 12 having a suction 13, discharge 14 and containing a rotor 16 rotatably mounted within the housing 12. The rotor 16 has a central bore 18 for receiving a motor shaft 19 for driving the same as will be described more fully hereafter. The rotor 16 is of the conventional vane type and comprises a plurality of vanes 20 slidable in slots in a cylindrical rotor body portion 21 and extending outwardly from the circumference thereof as is shown in FIG. 2. The rotating vanes 20 serve to pump air from the suction 13 to the discharge 14. The suction 13, of course, is connected to the main pump which is to be primed. One end of the pump assembly 10 is enclosed by a pump head 22. The other end of the pump assembly 10 is enclosed by a pump mounting head 24 of a special construction in accordance with the invention.

The mounting head 24 is shown in detail in FIGS. 3 to 6 and has a hub portion 26 and an annular rim portion 28 joined by a radially extending portion 30. The hub portion 26 is provided with a bore 32 adapted to receive, by a friction fit, a sleeve bearing 33 which serves as a bearing for the motor shaft 19 which extends therethrough into the rotor bore 18. A counterbore 34 is formed adjacent to bore 32 to provide an annular recess encircling the shaft 19 and containing a pair of annular seals 36 and 38 spaced apart axially. As is shown in FIG. 1, the seals 36 and 38 provide a seal between the shaft 19 and the mounting head 24.

The seals 36 and 38 are conventional oil lip seals designed to seal flow in one direction. Thus, the seal 36 is a vacuum seal which keeps air from rushing to the right as viewed in FIG. 1 toward the interior of the pump assembly 10. This entry of air into the pump assembly 10 could serve to destroy the vacuum created therein during the pumping action.

Figure 1:
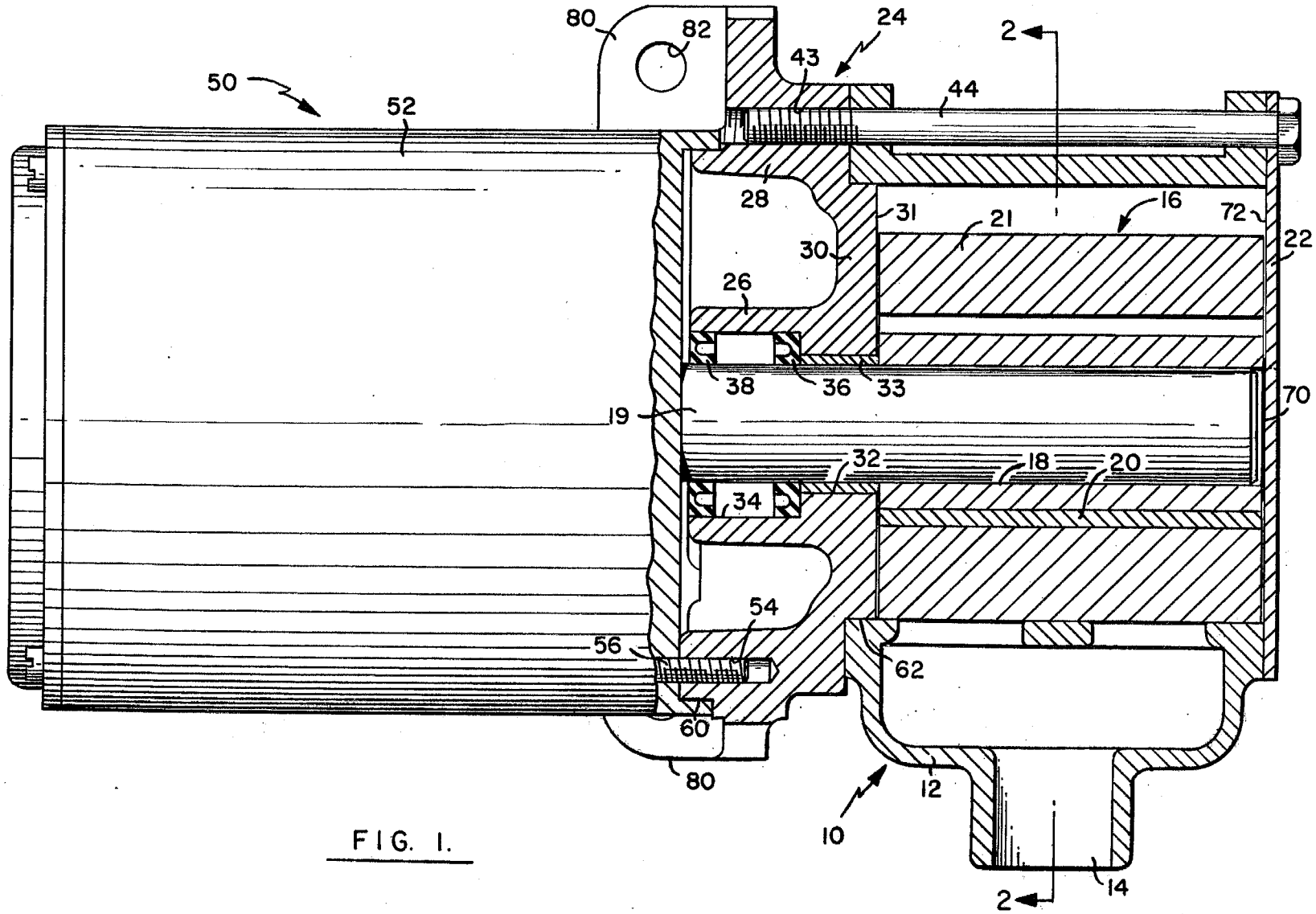
FIG. 1 is an elevation, partly in section, of a pump in accordance with the invention.

The seal 38 is constructed and arranged to prevent the flow of water to the left, as viewed in FIG. 1, to prevent any weepage of liquid that might occur during the operation of the pump assembly 10. In the priming cycle of the pump, whenever air is evacuated from the system, including the suction hose and the interior of the main pump, the water level will reach the main pump and start to be discharged from the priming pump. In order to purge the air-water mixture, it is desirable to continue the priming cycle for a few seconds after the flow of water begins until such time as a solid stream of water is delivered from the discharge of the priming pump at which time there is no longer any air left inside the main pump. It is, of course, important that the water which could seep from the pump assembly 10 along the motor shaft 19 does not come into contact with the electric portion of the motor assembly 50.

The mounting head 24 is provided with a drain passage 40 formed in a rib portion 42. The drain passage 40 extends from the bore 34 from a location between seals 36 and 38 (see FIG. 4) to the periphery of the rim portion 28. It is noted that when the pump is mounted for operation, the drain passage 40 will extend vertically downwardly. Thus, in the event that any liquid would get into the region of the counterbore 34, it would flow downwardly through the drain passage 40. The seal 38 serves to retain in the counterbore 34 any liquid that should pass from the pump assembly 10 into the counterbore 34.

The rim portion 28 is provided with four circumferentially spaced holes 43 which are tapped. The holes serve to receive bolts 44 which secure the mounting head 24 and the pump assembly 10 together as is shown in FIG. 1.

The pump is provided with a motor assembly 50 which includes a motor housing 52 which contains a conventional D.C. electric motor which causes rotation of the motor shaft 19. It is noted that the motor shaft 19 extends a substantial extent from the motor housing 52. Thus, when the motor assembly 50 is mounted in its operating condition, the shaft 19 is long enough to extend through the hub portion 26 of the mounting head 24 and into the central bore 18 of the rotor 16 for connection thereto by a suitable key 17 for driving the same.

Means are provided for mounting the motor assembly 50 onto the mounting head 24. To this end, the rim portion 28 is provided with two diametrically opposed tapped holes 54 adapted to receive the threaded ends of a pair of mounting bolts 56. The mounting bolts 56 secure the mounting head 24 and the motor assembly 50 together as is best shown in FIG. 1.

The mounting head 24 is provided with two pilots 60 and 62 which serve to position the motor assembly 50 and the pump assembly 10 accurately relative to one another and relative to the axis of the mounting head 24. Pilot 60 is a circular wall concentric with the axis of the mounting head 24 and guides the positioning of the motor assembly 50 such that its shaft 19 is centered on the axis of the mounting head 24 and is perpendicular to the face 64. It will be apparent that the motor assembly 50 has a pilot cooperating with the pilot 60.

Figure 6:
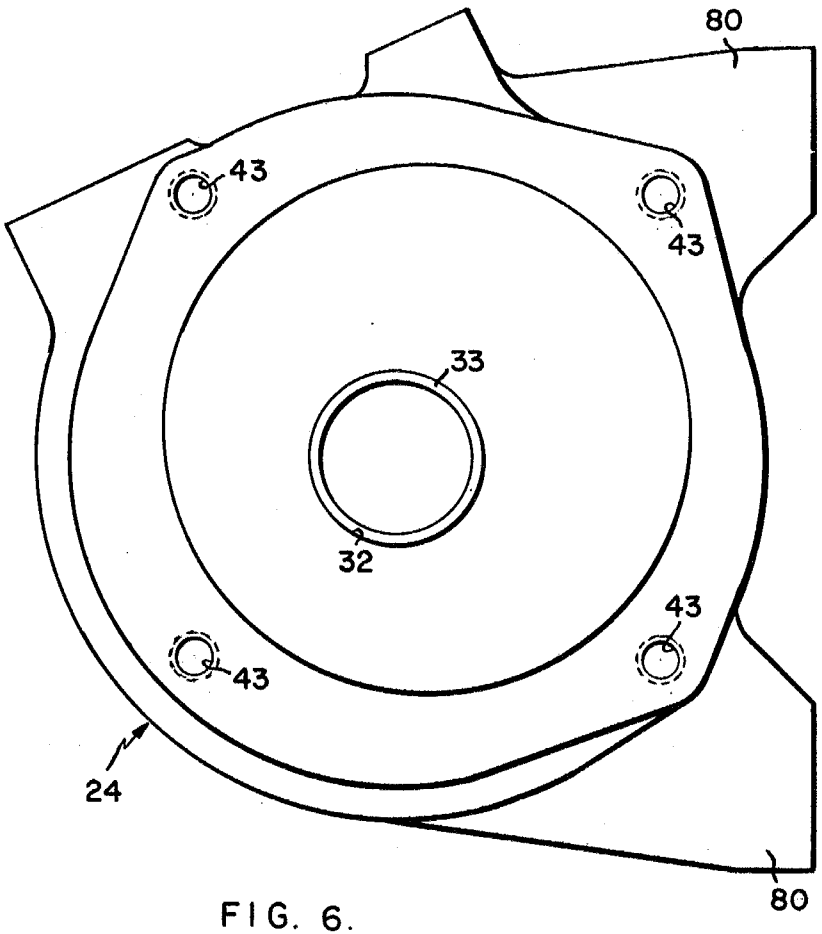
FIG. 6 is a view of the other side of the mounting head shown in FIG. 3.
Figure 4:
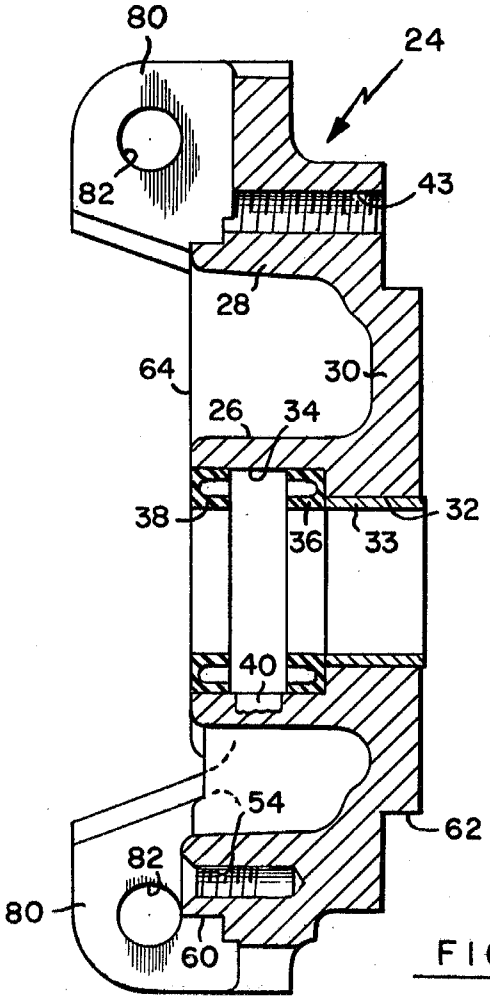
FIG. 4 is a section taken on line 4—4 of FIG. 3.

The pilot 62 is circular and extends on an axis eccentric with respect to the axis of the mounting head 24 as is best shown in FIG. 6. Pilot 62 guides the positioning of the pump assembly 10 for alignment with the motor assembly 50 and to receive the shaft 19. The pump assembly 10 has a pilot cooperating with the pilot 62.

In order to achieve the proper alignment between the motor assembly 50 and the pump assembly 10, it is important that the pilots 60 and 62 be manufactured accurately on the mounting head 24. Since these pilots 60 and 62 are made on the same part and this part is a flat plate, this accuracy is relatively easy to accomplish.

The outer end of the pump assembly 10 is closed by a pump head 22 which is mounted and positioned by means of the bolts 44. The pump head 22 has a flat configuration and is provided with a raised central portion 70 on its inside face 72 as is best shown in FIG. 1. The central portion 70 is circular and provides for a slight spacing (clearance) between the pump head 22 and the rotor 16 as will be described hereafter.

The pump housing 12 is provided with a small metered opening 74 (see FIG. 2) adapted to be connected to the lube oil line which is mounted in the tapped hold 76. During operation of the pump, oil is pulled in through the metered opening 74 for the lubrication of the rotor 16.

The mounting head 24 is provided with a pair of brackets 80 extending from the rim portion 28 and having bores 82 for receiving mounting bolts. The brackets 80 are used to mount the pump in the orientation shown in FIG. 1 with the mounting head 24 serving as the support for the pump assembly 10 and the motor assembly 50 each of which is secured to the mounting head 24 as described above.

In a positive displacement vane type vacuum pump of the type used in the priming pump of the invention, the amount of clearance around the rotor is critical to the attainment of the maximum vacuum obtainable with the pump, i.e., the efficiency of the pump. One important clearance region is where the outer diameter of the rotor body portion 21 comes closest to the inner diameter of its eccentric housing (see FIG. 2). Another critical region is the end clearance at each end of the rotor body portion 21 (see FIG. 1) which, by way of example, should be held within 0.001 and 0.003 inches at each end. The design in accordance with the invention is such that it is possible to locate the rotor with respect to the associated parts to maintain these critical clearances within the tolerances necessary.

The radial clearance between the outer diameter of the rotor and the housing inner diameter is accurately controlled by the design in accordance with the invention. Thus, the shaft 19 is restrained and held in axial alignment with the motor housing 52 by a ball bearing (not shown) in the end of the motor assembly 50 and the sleeve bearing 33 in the mounting head 24. The amount of eccentric between the bore 32 in the mounting head 24 and the pump housing pilot 62 is controlled accurately so that the radial clearance between the rotor outer diameter and the housing inner diameter can also be correspondingly accurately controlled.

The rotor body portion 21 is mounted onto the shaft 19 with a slip fit and is free to slide axially ("float") on the shaft 19. The key 17 is adapted to accommodate this axial movement of the rotor 16 on the shaft 19. The axial length of the rotor body portion 21 is held to a dimension that is about 0.006 inches less than the overall width of the pump housing which is measured between the face 72 of head 22 and the face 31 on the radial portion 30 of the mounting head within the pilot 62. Faces 31 and 72 are in opposed relation with rotor body portion 21 therebetween.

In accordance with a feature of the invention, the rotor body portion 21 is positioned in a way to minimize the friction caused by its rubbing against either the mounting head 24 or the head 22. To this end, the bearing 33 is pressed into the mounting head 24 and is set at a position in which the end face of the bearing 33 projects about 0.001 inches beyond the face 31 of the mounting head 24. By this arrangement, if the rotor 21 should "float" toward the head 24, it will only make contact with the annular end of the bearing 33, which contact is minimal and will result in minimizing friction drag, heat, etc.

At the other end of the rotor 21, the plate 22 is provided with the raised central portion 70 which has an outer diameter approximately the same as the bearing 33 and is aligned with this bearing 33. This raised portion is only about 0.001 inches in height and thus performs the same clearance function at the right end of the rotor body portion 21 as the bearing 33 performs at the left end of the rotor body portion 21.

In the preferred form, the raised portion 70 is manufactured by masking the remaining portion of the face 72 while hard anodizing the central portion, which portion will raise above the rest of the surface due to the anodizing growth. This raised center could also be obtained by dimpling or stamping the end plate or by attaching, as by cementing, a thin wafer to the plate 22.

By reason of the above arrangement, the rotor body portion 21 is restricted to contacting at each end a small area near its center to thereby minimize friction in the event that the rotor should float to the left toward the mounting head 24 or to the right toward the pump head 22.

I claim:

1. A vacuum pump adapted to be used as a priming pump comprising:

a pump assembly including a pump housing having a suction and a discharge opening, and a rotor rotatably mounted within said pump housing for pumping fluid between said suction and discharge openings, said rotor having a central bore for receiving a drive shaft, a motor assembly including a motor housing, and a motor shaft extending from said housing a substantial extent, a mounting head, means securing said pump assembly to one side of said mounting head, said mounting head enclosing said one end of said pump assembly and having a shaft bore, means securing said motor assembly to the other side of said mounting head with said motor shaft extending through said shaft bore of said mounting head and into said rotor central bore for driving said rotor, a pump head enclosing the other end of said pump assembly opposite said one end enclosed by said mounting head, said rotor being mounted on said motor shaft for slidable movement axially thereon and being arranged to extend between opposed faces of said mounting head and said pump head with a predetermined clearance, said pump head having a portion projecting inwardly toward said rotor from said opposed face of said pump head for contacting the rotor in a limited region near its center, and a sleeve bearing mounted in said shaft bore for rotatably supporting said motor shaft within said mounting head, said sleeve bearing extending inwardly toward said rotor beyond said opposed face of said mounting head for contacting the rotor in an annular region around the motor shaft.

2. A pump according to claim 1 in which said mounting head is provided with a first pilot located on said one side of said mounting head onto which said pump assembly is secured and a second pilot located on the other side of said mounting head onto which said motor assembly is secured, said first and second pilots cooperating with said pump assembly and said motor assembly, respectively, for aligning the same relative to one another, said first pilot comprising a circular wall eccentrically arranged with respect to said shaft bore, and said second pilot comprising a circular wall concentrically arranged with respect to said shaft bore.

3. A pump according to claim 2 in which said mounting head is provided with an annular recess adjacent said shaft bore encircling said motor shaft, sealing means contained within said recess for sealing said motor shaft around the circumference thereof against the flow of liquid from the interior of said pump housing through said mounting head and against the flow of air into said pump housing, said sealing means comprising a pair of circumferentially extending seals spaced apart axially, said mounting head being provided with a drain passage extending from said annular recess to the exterior of said mounting head, said drain passage communicating with said annular recess at a location between the axially spaced sealing members.

* * * * *